US005699728A

United States Patent [19]

Huang

[11] Patent Number: 5,699,728

[45] Date of Patent: Dec. 23, 1997

[54] WASTE FOOD TREATMENT APPARATUS

[76] Inventor: Chen-Hsien Huang, No. 3-2, Lane 8, Alley 47, Hsan-Fu Street, Shu-Lin Town, Taipei Hsien, Taiwan

[21] Appl. No.: 698,159

[22] Filed: Aug. 7, 1996

[51] Int. Cl.[6] ..... B30B 9/14

[52] U.S. Cl. ..... 100/98 R; 100/117; 100/127; 100/145

[58] Field of Search ..... 100/98 R, 117, 100/127, 145, 147, 148, 149

[56] References Cited

U.S. PATENT DOCUMENTS

| | | | |
|---|---|---|---|
| 488,956 | 12/1892 | Sobotka et al. | 100/117 |
| 3,062,129 | 11/1962 | Wandel | 100/147 |
| 3,144,818 | 8/1964 | Sullivan | 100/98 R |
| 3,164,329 | 1/1965 | Wandel | 100/98 R |
| 3,188,942 | 6/1965 | Wandel | 100/127 |
| 3,319,897 | 5/1967 | Craig et al. | 100/98 R |
| 3,688,687 | 9/1972 | Craig et al. | 100/145 |
| 3,921,512 | 11/1975 | Burns | 100/117 |
| 4,212,239 | 7/1980 | Fraula et al. | 100/117 |
| 4,651,636 | 3/1987 | Fields | 100/98 R |

FOREIGN PATENT DOCUMENTS

| | | | |
|---|---|---|---|
| 1275801 | 10/1961 | France | 100/145 |

*Primary Examiner*—Stephen F. Gerrity

[57] ABSTRACT

A waste food treatment apparatus including a screw rod turned in a container by a motor unit through a spindle to squeeze water from waste food, a scraper turned by the motor unit to scrape out food dreg, a circular block and a food dreg propelling block fixedly secured to the scraper at different elevations, and a handle coupled to the circular block by ball bearings and turned to lift the scraper and the food dreg propelling block without stopping them from being turned by the motor unit through the spindle, for permitting food dregs to be positively scraped out.

2 Claims, 4 Drawing Sheets

WASTE FOOD TREATMENT APPARATUS

BACKGROUND OF THE INVENTION

The present invention relates to waste food treatment apparatus, and relates more particularly to such a waste food treatment apparatus which has means to positively scrape out food dregs after treatment.

Because waste food spoils quickly, it must be properly disposed of. It is more hygienic to squeeze water out of waste food before it is thrown away. FIG. 1 shows a waste food treatment apparatus designed for this purpose. This structure of waste food treatment apparatus comprises a container 1', a transmission mechanism 2', a screw rod 3' coupled to the transmission mechanism 2' and having a spiral blade 31', and a scraper 6' coupled to the screw rod 3' at the top and turned with screw rod 3' to scrape out food dregs. Because there is a difference in elevation X between the scraper 6' and the spiral blade 31', food dregs tend to be gathered in this area when the scraper 6' is rotated to scrape out food dregs. If food dregs are gathered inside the apparatus, the internal mechanical structure of the apparatus tend to be covered with rust, or to corrodes quickly.

SUMMARY OF THE INVENTION

The present invention has been accomplished to provide a waste food treatment apparatus which eliminates the aforesaid problem. According to the present invention, a circular block and a food dreg propelling block fixedly secured to the scraper at different elevations, and a handle is coupled to the circular block by ball bearings and turned to lift the scraper and the food dreg propelling block without stopping them from being turned by the motor unit of the apparatus, for permitting food dregs to be positively scraped out.

DETAILED DESCRIPTION OF THE PREFERRED EMBODIMENT

Figure 1:
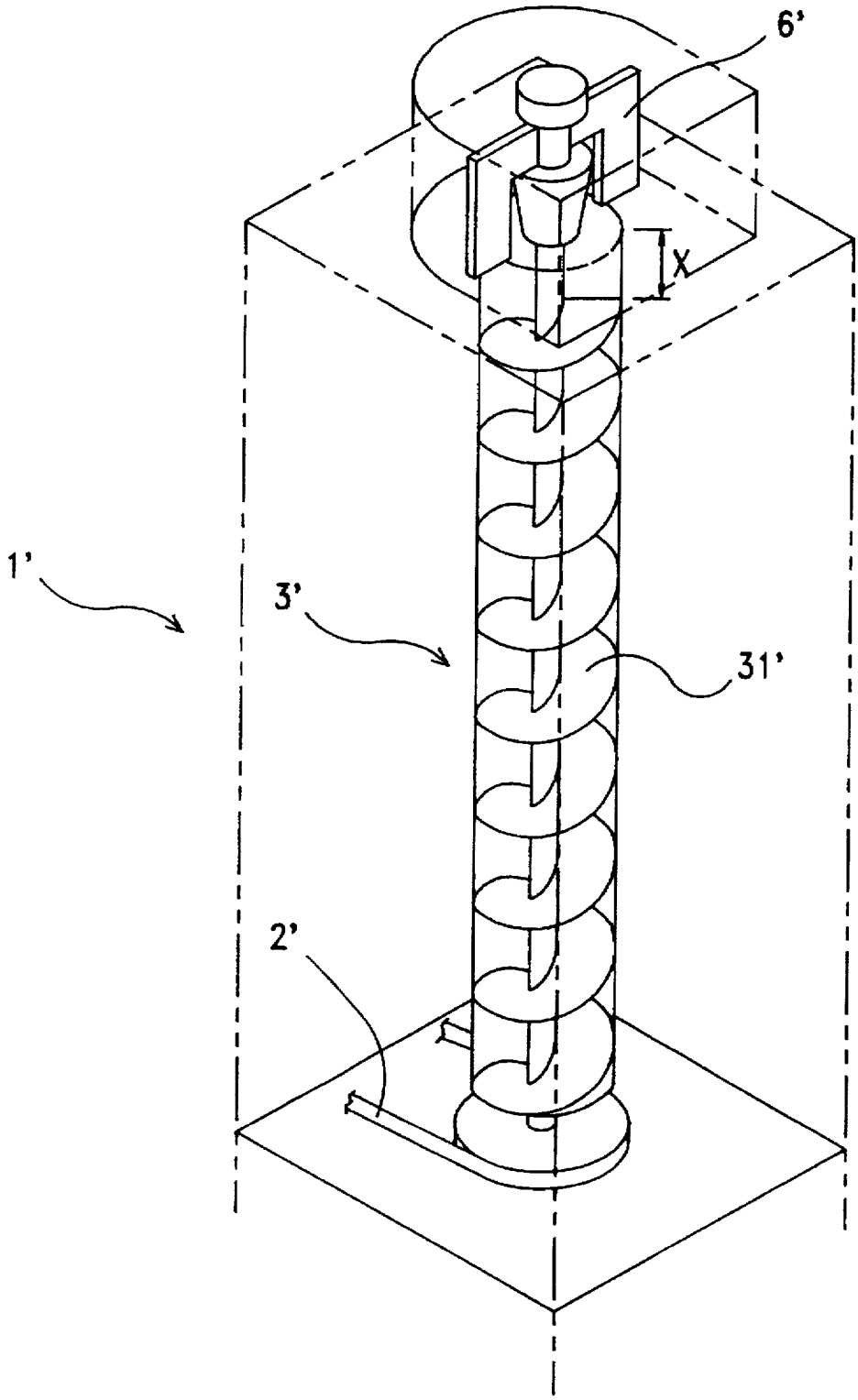
FIG. 1 (PRIOR ART)
FIG. 1 shows the structure of a waste food treatment apparatus according to the prior art.
Figure 2:
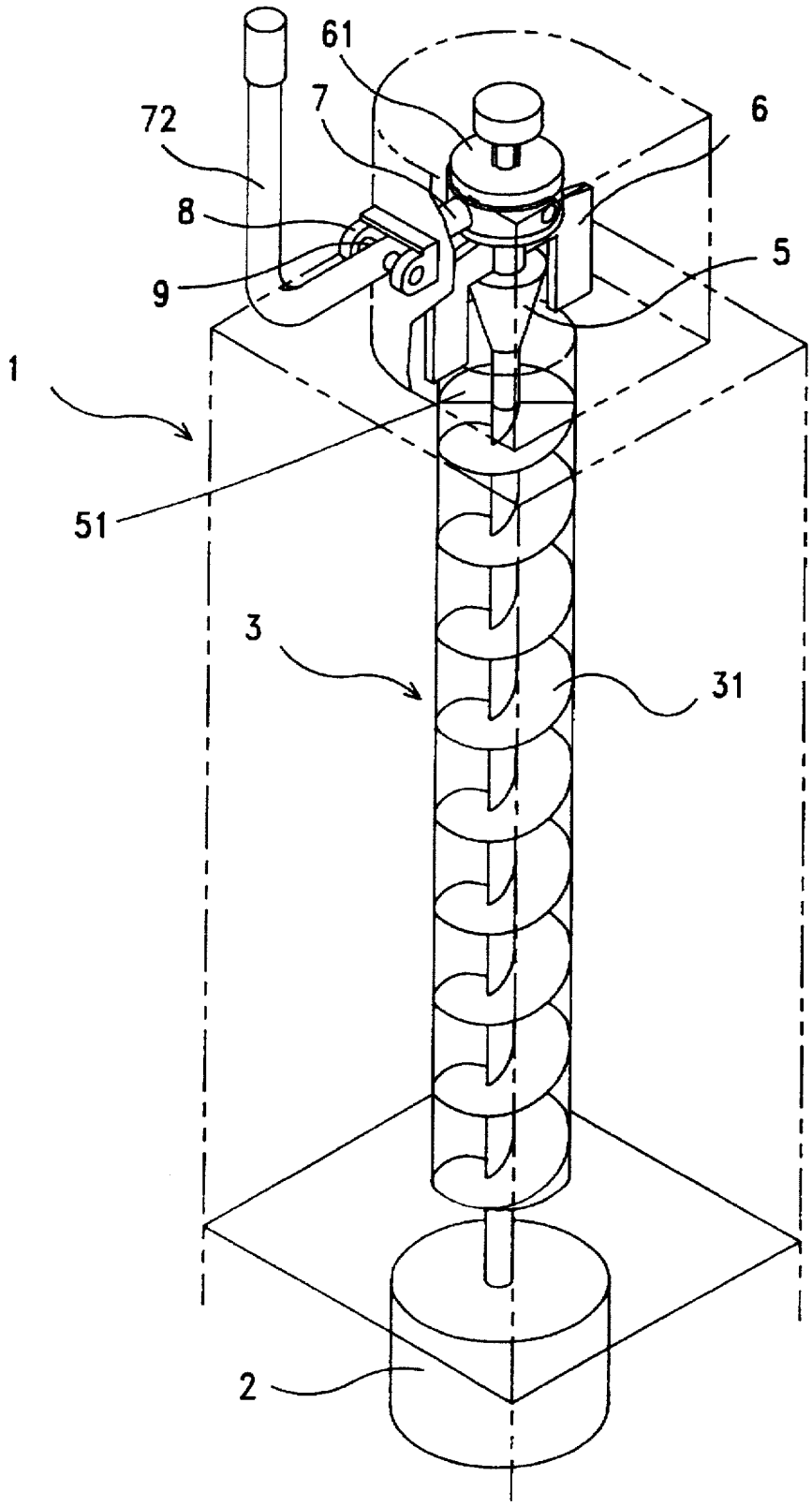
FIG. 2 shows the structure of a waste food treatment apparatus according to the present invention.
Figure 3:
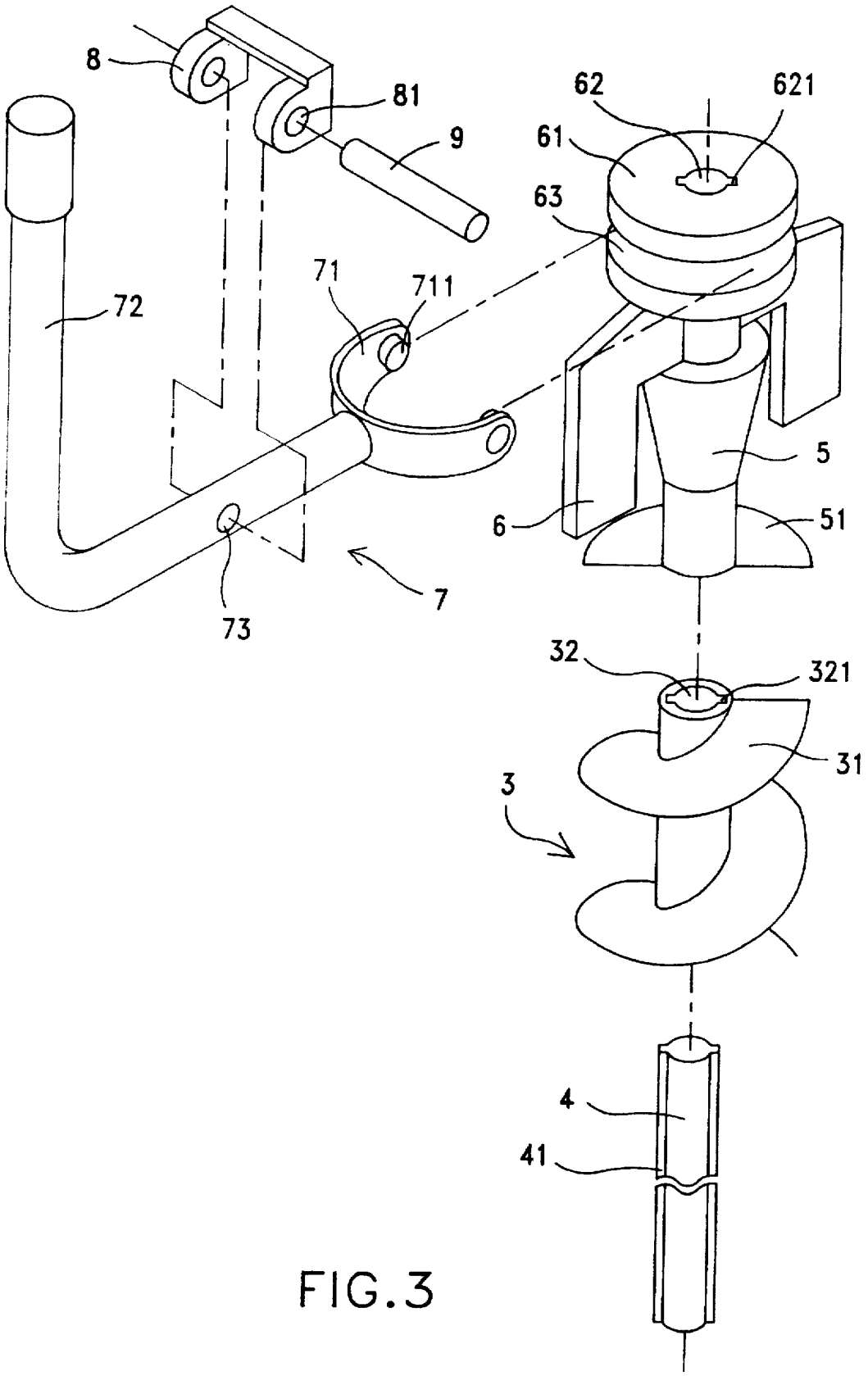
FIG. 3 is an exploded view of the internal mechanical structure of the waste food treatment apparatus shown in FIG. 2.

Referring to FIGS. 2 and 3, a waste food treatment apparatus in accordance with the present invention is generally comprised of a container 1, a motor unit 2, a screw rod 3 having a spiral blade 31 raised around the periphery along the length, a food dreg propelling block 5, a scraper 6, a circular block 61, and a handle 7. The food dreg propelling block 5 is mounted on the screw rod 3 at the top end thereof, having a propelling flange 51 raised around the periphery at the bottom. The scraper 6 is mounted on the food dreg propelling block 5 at the top. The circular block 61 is mounted on the scraper 6 at the top, having an annular groove 63 around the periphery. The handle 7 comprises a L-shaped handle body 72, a coupling fork 71 disposed at one end of the handle body 72 and having two opposing ball bearings 711 respectively coupled to the annular groove 63 of the circular block 61. The screw rod 3 has a longitudinal center through hole 32 which receives a spindle 4, which is coupled to the motor unit 2 and has two longitudinal coupling ribs 41 raised from the periphery at two opposite sides along the length, and two longitudinal coupling grooves 321 bilaterally disposed in communication with the longitudinal center through hole 32 along its length and engaged with the longitudinal coupling ribs 41 of the spindle 4. The circular block 61 has an axial center through hole 62 and two longitudinal coupling grooves 621 respectively and longitudinally extending through the axial center of the scraper 6 and the axial center of the food dreg propelling block 5 and aligned with the longitudinal center through hole 32 and longitudinal coupling grooves 321 of the screw rod 3 for engagement with the spindle 4. Therefore, when the motor 2 is started to turn the spindle 4, the screw rod 3, the food dreg propelling block 5, the scraper 6, and the circular block 61 are simultaneously turned with the spindle 4. A handle holder 8 is fixedly mounted on the container 1 at a suitable location. A through hole (not shown) is made through the container 1 for the passing of the handle body 72 of the handle 7. The handle body 72 of the handle 7 has a pivot hole 73, which is pivotably coupled to through holes 81 of the handle holder 8 by a pivot 9. Therefore, through the handle body 72 of the handle 7, the handle 7 can be turned about the pivot 9 to lift the circular block 61.

Figure 5:
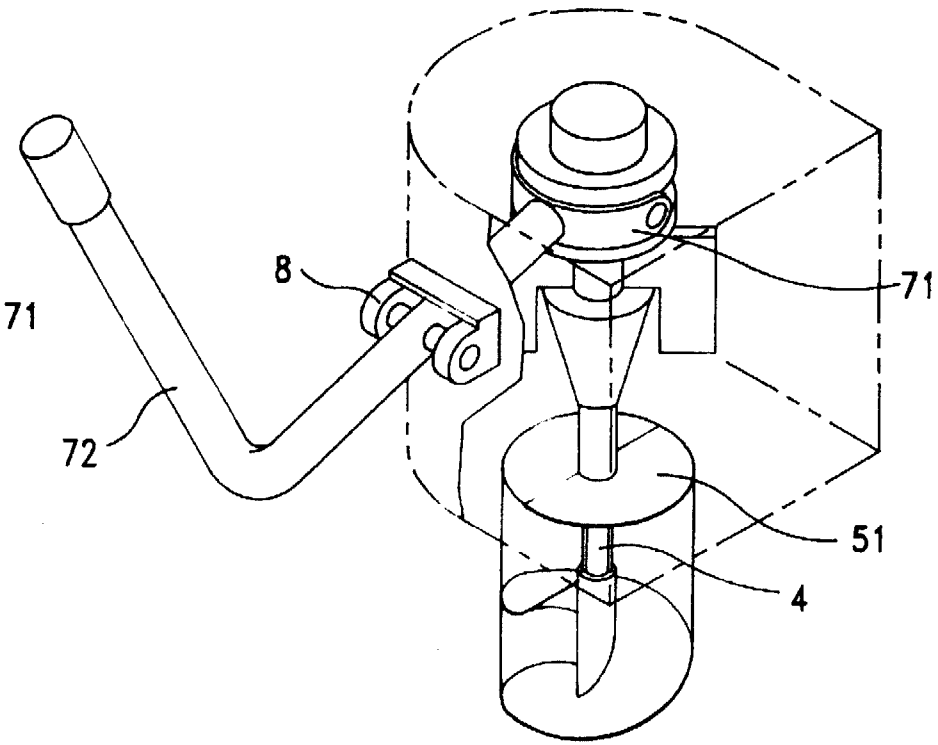
FIG. 5 is similar to FIG. 4 but showing the handle turned downwards, and the food dreg propelling device lifted.
Figure 4:
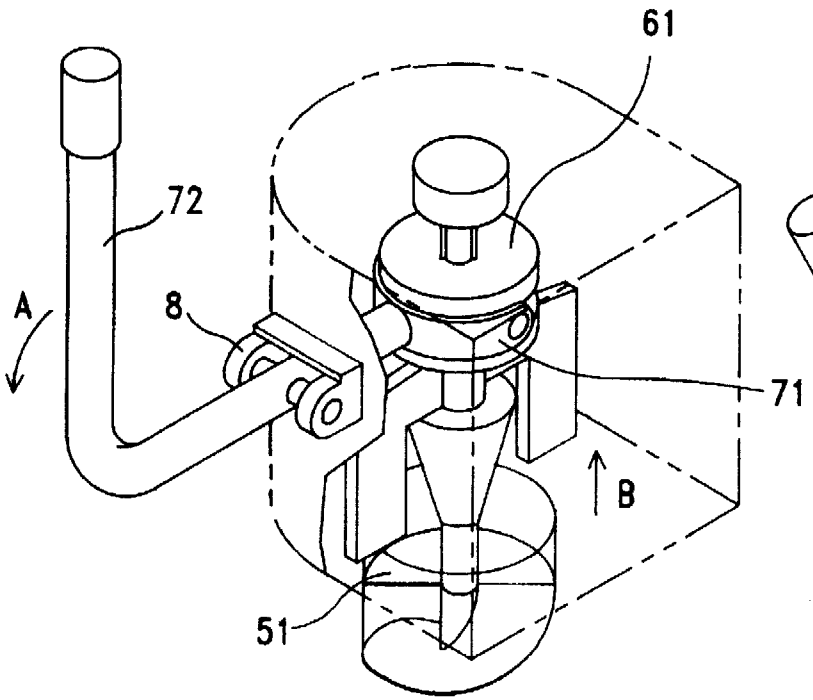
FIG. 4 is a perspective view of the upper part of the waste food treatment apparatus according to the present invention, showing the handle not operated.

Referring to FIGS. 4 and 5, when the handle body 72 of the handle 7 is turned downwards in direction A, the circular block 61, the scraper 6, and the food dreg propelling block 5 are lifted in direction B. When the food dreg propelling block 5 is lifted during its rotary motion, the propelling flange 51 is moved upwards and continuously turned to propel out food dregs. This operation step is performed only when water is squeezed out of waste food.

While only one embodiment of the present invention has been shown and described, it will be understood that various modifications and changes could be made without departing from the spirit and scope of the invention disclosed.

What the invention claimed is:

1. A waste food treatment apparatus comprising a motor unit, a container covered on said motor unit, a spindle turned by said motor unit, a screw rod disposed in said container and coupled to said spindle and having a spiral blade raised around the periphery and being turned to squeeze water out of waste food being put in said container, a scraper turned by said spindle to scrape out food dregs, and a food dreg propelling mechanism controlled to propel food dregs, permitting food dregs to be scraped out by said scraper, wherein said food dreg propelling mechanism comprises a food dreg propelling block fixedly secured to said scraper at the bottom and spaced above the spiral blade of said screw rod and having an outward propelling flange raised around the periphery, a circular block fixedly secured to said scraper at the top and coupled to said spindle, said circular block comprising a longitudinal center through hole extending through said scraper and said food dreg propelling block, at least one longitudinal coupling groove extending through said scraper and said food dreg propelling block and longitudinally disposed in communication with said longitudinal center through hole at one side along its length, and an annular groove around the periphery, a handle holder fixedly secured to said container and having a horizontal pivot, and a substantially L-shaped handle turned about the horizontal pivot of said handle holder and adapted for lifting said circular block, said scraper, and said food dreg propelling block for permitting food dregs to be scraped out by said scraper and said food dreg propelling block, said handle having one end extending out of said container through a hole thereof and an opposite end terminating in a coupling fork coupled to the annular groove of said circular block by ball bearings for permitting said circular block to be turned by said spindle relative to said coupling fork; said screw rod has a longitudinal center through hole and at least one longitudinal coupling groove disposed in communication with the longitudinal center through hole of said screw rod at one side along its length; said spindle has at least one longitudinal coupling rib raised from the periphery along the length and respectively engaged with the at least one longitudinal coupling groove of said screw rod and the at least one longitudinal coupling groove of said circular block to stop said screw rod and said circular block and said scraper and said food dreg propelling block from rotary motion relative to said spindle, for permitting said circular block and said scraper and said food dreg propelling block to be moved axially along said spindle.

2. The waste food treatment apparatus of claim 1, wherein said circular block and said screw rod have a respective pair of longitudinal coupling grooves bilaterally disposed in communication with the respective longitudinal center through hole; said spindle has two longitudinal coupling ribs longitudinally and bilaterally raised along the periphery and respectively engaged with the longitudinal coupling grooves of said screw rod and the longitudinal coupling grooves of said circular block.

* * * * *